US011498086B2

(12) United States Patent
Xiao

(10) Patent No.: US 11,498,086 B2
(45) Date of Patent: Nov. 15, 2022

(54) WATER DROPLET GENERATING APPARATUS

(71) Applicants: LESHOW ELECTRONIC TECHNOLOGY CO. LTD., Hangzhou (CN); BEIJING XIAOMI MOBILE SOFTWARE CO., LTD., Beijing (CN)

(72) Inventor: Zhaoxian Xiao, Hangzhou (CN)

(73) Assignees: Leshow Electronic Technology Co. Ltd., Hangzhou (CN); Beijing Xiaomi Mobile Software Co., Ltd., Beijing (CN)

( * ) Notice: Subject to any disclaimer, the term of this patent is extended or adjusted under 35 U.S.C. 154(b) by 174 days.

(21) Appl. No.: 16/613,746

(22) PCT Filed: Apr. 9, 2018

(86) PCT No.: PCT/CN2018/082274
§ 371 (c)(1),
(2) Date: Nov. 14, 2019

(87) PCT Pub. No.: WO2018/219042
PCT Pub. Date: Dec. 6, 2018

(65) Prior Publication Data

US 2020/0070188 A1 Mar. 5, 2020

Related U.S. Application Data

(63) Continuation of application No. PCT/CN2018/082274, filed on Apr. 9, 2018.

(30) Foreign Application Priority Data

May 31, 2017 (CN) ..... 201720651351.8

(51) Int. Cl.
*B05B 5/053* (2006.01)
*B05B 5/025* (2006.01)

(52) U.S. Cl.
CPC ..... *B05B 5/0533* (2013.01); *B05B 5/0255* (2013.01)

(58) Field of Classification Search
CPC ... B05B 5/0533; B05B 5/0255; B05B 5/0536; B05B 5/0535; B05B 5/057
(Continued)

(56) References Cited

U.S. PATENT DOCUMENTS 6,311,903 B1 * 11/2001 Gaw ..... A45D 34/00 239/708
7,494,532 B2 * 2/2009 Azukizawa ..... F24F 6/18 95/71
(Continued)

FOREIGN PATENT DOCUMENTS

CN 1802219 A 7/2006
CN 1809363 A 7/2006
(Continued)

OTHER PUBLICATIONS

First Office issued to Japanese Application No. 2019-530025, dated Jul. 14, 2020 with English translation, (6p).
(Continued)

*Primary Examiner* — Joseph A Greenlund
(74) *Attorney, Agent, or Firm* — Arch & Lake LLP

(57) ABSTRACT

An apparatus is provided for generating water droplets. The apparatus includes: a condensation rod for condensing water vapor in air around the condensation rod on the condensation rod, the condensation rod being a cylinder that is rotationally symmetric about a central axis, and a circumferential surface of the cylinder being a condensing surface for aggregating condensed water; a cooling device being in contact with the condensation rod for cooling the condensation rod; an atomizing electrode; and a high voltage power supply for applying a high voltage to the atomizing elec-
(Continued)

trode, and causing the condensed water on the condensation rod to be excited by a high pressure corona to form atomized water.

10 Claims, 3 Drawing Sheets

(58) Field of Classification Search
USPC ..... 239/690
See application file for complete search history.

(56) References Cited

U.S. PATENT DOCUMENTS

| | | | | |
|---|---|---|---|---|
| 7,644,511 | B2 * | 1/2010 | Ishikawa | A45D 20/12 34/96 |
| 7,854,403 | B2 * | 12/2010 | Yano | B05B 5/0255 239/700 |
| 8,191,805 | B2 | 6/2012 | Nakada | |
| 8,292,202 | B2 * | 10/2012 | Hirai | B05B 5/057 239/690 |
| 8,398,005 | B2 * | 3/2013 | Nakada | B05B 5/057 239/708 |
| D682,226 | S * | 5/2013 | Omori | D13/182 |
| 8,505,839 | B2 * | 8/2013 | Yano | B05B 5/001 239/706 |
| 9,101,947 | B2 * | 8/2015 | Kobayashi | B05B 5/053 |
| 11,026,491 | B2 * | 6/2021 | Xiao | A45D 20/12 |
| 2002/0074491 | A1 | 6/2002 | Fukuda | |
| 2003/0205629 | A1 * | 11/2003 | Kelly | F23D 11/38 239/690 |
| 2005/0097770 | A1 * | 5/2005 | Sabbatini | A45D 20/12 34/96 |
| 2006/0064892 | A1 * | 3/2006 | Matsui | B05B 5/1691 34/96 |
| 2006/0131449 | A1 * | 6/2006 | Azukizawa | B05B 5/057 239/690 |
| 2006/0144971 | A1 * | 7/2006 | Nakada | A61L 9/145 239/690 |
| 2007/0166208 | A1 * | 7/2007 | Tanaka | A45D 20/12 422/186.04 |
| 2009/0001200 | A1 * | 1/2009 | Imahori | B05B 5/0533 239/690 |
| 2009/0121050 | A1 * | 5/2009 | Nakano | B05B 5/057 239/690 |
| 2009/0134248 | A1 * | 5/2009 | Yamaguchi | B05B 5/057 239/132.3 |
| 2009/0179092 | A1 * | 7/2009 | Akisada | B05B 5/0255 239/602 |
| 2009/0206185 | A1 * | 8/2009 | Akisada | B05B 5/057 239/690 |
| 2010/0044475 | A1 | 2/2010 | Nakada | |
| 2010/0327089 | A1 * | 12/2010 | Nakada | A61L 9/14 239/690 |
| 2011/0031335 | A1 * | 2/2011 | Hirai | B05B 5/057 239/690 |
| 2012/0067986 | A1 * | 3/2012 | Kobayashi | H01L 35/34 239/690 |
| 2012/0175440 | A1 * | 7/2012 | Uegaki | H05K 9/0049 239/690 |
| 2013/0020497 | A1 * | 1/2013 | Suda | A61L 2/14 250/423 R |
| 2013/0146683 | A1 * | 6/2013 | Imai | B05B 5/057 239/690 |
| 2013/0153690 | A1 * | 6/2013 | Omori | B05B 5/00 239/690 |
| 2013/0320117 | A1 * | 12/2013 | Kobayashi | B05B 5/057 239/690 |
| 2014/0203117 | A1 * | 7/2014 | Yano | B05B 7/0075 239/690 |
| 2014/0209710 | A1 * | 7/2014 | Komura | B05B 5/053 239/690 |
| 2016/0096185 | A1 | 4/2016 | Nobuo | |
| 2016/0116193 | A1 * | 4/2016 | Uratani | B05B 5/0255 239/690 |
| 2018/0034248 | A1 * | 2/2018 | Ishigami | B05B 5/057 |
| 2019/0115144 | A1 * | 4/2019 | Park | H01F 27/2876 |
| 2019/0269219 | A1 * | 9/2019 | Xiao | A45D 20/20 |
| 2020/0070188 | A1 * | 3/2020 | Xiao | B05B 5/0536 |
| 2021/0078022 | A1 * | 3/2021 | Xiao | B05B 5/087 |

FOREIGN PATENT DOCUMENTS

| | | | |
|---|---|---|---|
| CN | 101095562 | A | 1/2008 |
| CN | 101444359 | A | 6/2009 |
| CN | 101563165 | A | 10/2009 |
| CN | 102006942 | A | 4/2011 |
| CN | 101563165 | B | 5/2012 |
| CN | 103119384 | A | 5/2013 |
| CN | 103844545 | A | 6/2014 |
| CN | 105665170 | A | 6/2016 |
| CN | 206810524 | U | 12/2017 |
| EP | 2412442 | A1 | 2/2012 |
| JP | 2004358362 | A | 12/2004 |
| JP | 2005177685 | A | 7/2005 |
| JP | 2005296753 | A | 10/2005 |
| JP | 2006075702 | A | 3/2006 |
| JP | 2006205013 | A | 8/2006 |
| JP | 2006272092 | A | 10/2006 |
| JP | 4475192 | B2 | 2/2007 |
| JP | 200729850 | A | 2/2007 |
| JP | 2007021373 | A | 2/2007 |
| JP | 2007029850 | A | 2/2007 |
| JP | 4595748 | B2 | 3/2007 |
| JP | 2007181837 | A | 7/2007 |
| JP | 2008126139 | A | 6/2008 |
| JP | 2008155121 | A | 7/2008 |
| JP | 2008190813 | A | 8/2008 |
| JP | 2009131407 | A | 6/2009 |
| JP | 2009255003 | A | 11/2009 |
| JP | 4379473 | B2 | 12/2009 |
| JP | 4415490 | B2 | 2/2010 |
| JP | 2010089088 | A | 4/2010 |
| JP | 2011067769 | A | 4/2011 |
| JP | 2013049038 | A | 3/2013 |
| JP | 2013220365 | A | 10/2013 |
| JP | 2014050804 | A | 3/2014 |
| JP | 5508207 | B2 | 5/2014 |
| JP | 2014147635 | A | 8/2014 |
| JP | 5612322 | B2 | 10/2014 |
| KR | 100716638 | B1 | 5/2007 |
| WO | 2008065737 | A1 | 6/2008 |
| WO | 2009037946 | A1 | 3/2009 |
| WO | 2009136470 | A1 | 11/2009 |

OTHER PUBLICATIONS

First Office Action issued to Korean Application No. 10-2019-7009659, dated Jun. 30, 2020 with English translation, (12p).

Extended European Search Report issued to European Application No. 18809296.9 dated May 15, 2020, (8p).

Office Action Decision to Grant Patent issued to Japanese Application No. 2019-530025, dated Nov. 4, 2020 with English translation, (5p).

International Search Report (including English translation) and Written Opinion issued in PCT/CN2018/082274, dated Jul. 12, 2018, 10 pages.

International Search Report issued in PCT/CN2018/082275, dated Jul. 12, 2018, 4 pages.

Chinese Patent 1st Office Action (including English translation) issued in CN201710426368.8, dated Jul. 9, 2020, 13 pages.

European Extended Search Report issued in EP18810327.9, dated May 15, 2020, 7 pages.

Japanese Patent Notice of Allowance (including Engish translation) issued in JP2019528696, dated Jul. 2, 2020, 5 pages.

Korean Patent 1st Office Action (including English translation) issued in KR10-2021-7012019, dated May 21, 2021, 8 pages.

Korean Patent Notice of Allowance (including English translation) issued in KR10-2019-7009657, dated Jan. 22, 2021, 6 pages.

(56) References Cited

OTHER PUBLICATIONS

Notice of Allowance issued in Korean Application No. 10-2021-701219 dated Nov. 16, 2021, (3p).

* cited by examiner

WATER DROPLET GENERATING APPARATUS

CROSS-REFERENCE TO RELATED APPLICATIONS

This application is a national phase application under 35 U.S.C. § 371 of International Patent Application No. PCT/CN2018/082274, filed on Apr. 9, 2018, which is based upon and claims priority to Chinese Patent Application No. 201720651351.8, filed on May 31, 2017, the entire contents of which are incorporated herein by reference for all purposes.

TECHNICAL FIELD

The present disclosure relates to the field of atomizing apparatuses and, more particularly, to an apparatus for generating water droplets.

BACKGROUND

In the apparatus for generating high-voltage corona atomizing water particles existing in the industry, the cooling apparatus cools an emitter electrode and condenses water vapor in surrounding air on the emitter electrode. When a high voltage power supply applies a high voltage to the emitter electrode, water condensed on the emitter electrode is atomized by a high voltage corona. In order to achieve discharge and condensation effects of the emitter electrode, the emitter electrode is usually designed to have a shape of tapered rod, and the closer to the top, the smaller the diameter of the rod. Due to the tapered shape of the emitter electrode, the distribution of the condensed water on the emitter electrode may not achieve an optimal aggregation effect. A discharge head of the tip of the emitter electrode is designed to include a flange at a junction between the discharge head and the rod, the flange is configured to extend radially outward from the discharge head and the rod beyond the entire circumference of the discharge head, and the discharge head is gradually reduced to have an outwardly convex side profile. In short, the top of the discharge head is spherical in order to condense the condensed water on the spherical discharge head, and a discharge occurrence position is also on the spherical discharge head, so as to atomize the condensed water while discharging. The spherical shape at the top of the discharge head is highly demanding in processing technology, and the defective rate and processing cost of the molding are high. At the same time, the shape of the discharge head also matches a needle electrode placed at the top end of the discharge head. Therefore, how to improve yield of product molding, reduce processing costs, and simplify the processing technology, have been explored in the industry.

SUMMARY

The present disclosure provides an apparatus for generating water droplets.

According to a first aspect of the present disclosure, an apparatus for generating water droplets is provided, including: a condensation rod for condensing water vapor in air around the condensation rod on the condensation rod, the condensation rod being a cylinder that is rotationally symmetric about a central axis, and a circumferential surface of the cylinder being a condensing surface for collecting condensed water; a cooling device being in contact with the condensation rod for cooling the condensation rod; an atomizing electrode; and a high voltage power supply for applying a high voltage to the atomizing electrode, and causing the condensed water on the condensation rod to be excited by a high pressure corona to form atomized water droplets.

It is to be understood that the above general descriptions and detailed descriptions below are only exemplary and explanatory and not intended to limit the present disclosure.

BRIEF DESCRIPTION OF THE DRAWINGS

The accompanying drawings, which are incorporated in and constitute a part of this specification, illustrate examples consistent with the present disclosure and, together with the description, serve to explain the principles of the present disclosure.

DETAILED DESCRIPTION

The present disclosure will be further described below with reference to the accompanying drawings. The following description refers to the accompanying drawings in which the same numbers in different drawings represent the same or similar elements unless otherwise represented. The implementations set forth in the following description of exemplary aspects do not represent all implementations consistent with the present disclosure. Instead, they are merely examples of apparatuses consistent with aspects related to the present disclosure.

The terminology used in the present disclosure is for the purpose of describing particular examples only and is not intended to limit the present disclosure. As used in this disclosure and the appended claims, the singular forms "a", "an", and "the" are intended to include the plural forms as well, unless the context clearly indicates otherwise.

The terms "water droplets" and "water particles" may be used interchangeably in the present disclosure.

Figure 1:
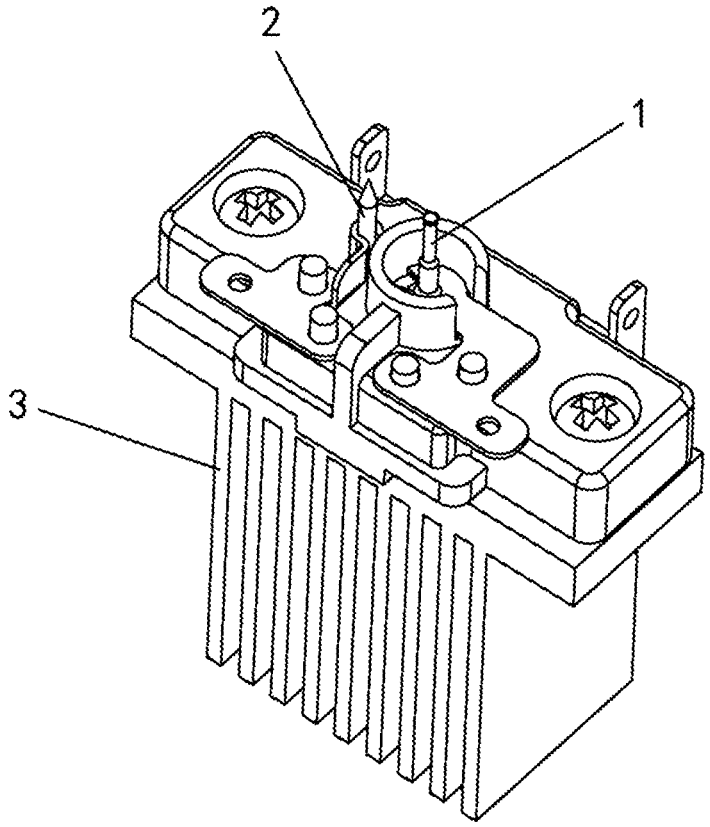
FIG. 1 is a block diagram illustrating an apparatus for generating water droplets according to an example.
Figure 2:
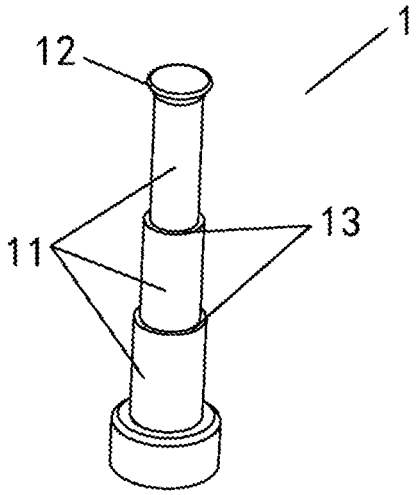
FIG. 2 is a block diagram illustrating a condensation rod according to an example.
Figure 3:
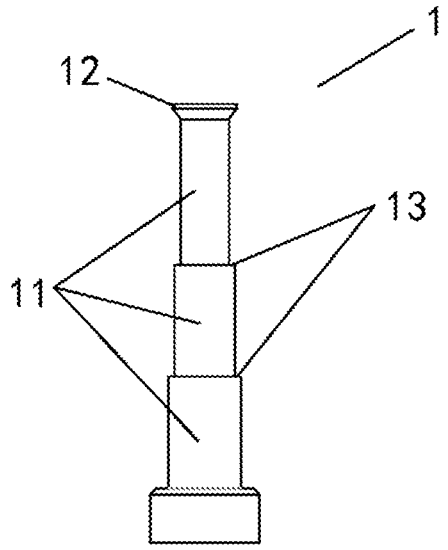
FIG. 3 is a front view of the condensation rod according to an example.

The example provides an apparatus for generating water particles, as shown in FIG. 1 to FIG. 3, the apparatus for generating water particles including: a condensation rod 1 for condensing water vapor in air around the condensation rod 1 on the condensation rod 1, the condensation rod 1 being a cylinder that is rotationally symmetric about a central axis, and a circumferential surface of the cylinder being a condensing surface 11 for aggregating condensed water; a cooler or a cooling device 2 being in contact with the condensation rod 1 for cooling the condensation rod 1; an atomizing electrode 3; and a high voltage power supply (not shown in FIG. 1) for applying a high voltage to the atomizing electrode, and causing the condensed water condensed on the condensation rod to be excited by a high pressure corona to form atomized water particles. The condensation rod 1 in the example of the present disclosure is a cylinder that is rotationally symmetric about a central axis, and the circumferential surface of the cylinder is a condensing surface 11 for aggregating condensed water, allowing the condensed water to condense to the condensing surface of the cylinder of the condensation rod, so that a condensed area available for the condensed water is relatively large. Since the condensation rod 1 is in the shape of a cylinder, and the circumferential surface thereof has no inclined tapered slope, the water in the air may be uniformly condensed on or arranged on the condensing surface of the cylinder. When the condensed water aggregates to a certain volume, it may slide down smoothly to avoid excessive amount of water wrapped around the condensation rod 1 and weakening atomization effect.

The top of the condensation rod 1 has a water collecting end 12 that expands outward from the condensing surface 11, and a diameter of the outer edge of the water collecting end 12 is larger than a circumferential diameter of the condensing surface. In the example of the present disclosure, the top of the condensation rod 1 has the water collecting end 12, and the diameter of the outer edge of the water collecting end 12 is larger than the circumferential diameter of the condensing surface. When condensed water is generated on the condensing surface, due to occlusion of the water collecting end 12, the condensed water may be effectively prevented from coming off the condensing surface driven by air flow. A top surface of the water collecting end 12 is flat. In order to avoid discharge of the condensation rod 1 on its top, a flat water collecting end 12 is provided to avoid movement of charged ions attached to the condensation rod 1 towards the top of the condensation rod.

The water collecting end 12 is smoothly and transitionally connected to the condensing surface 11. In order to prevent the charged ions attached to the condensation rod 1 from moving toward a sharp angle joint to cause a discharge phenomenon, the water collecting end 12 and the condensing surface 11 adopt a smooth transition to avoid a connection sharp angle.

For example, the condensing surface 11 of the condensation rod may have a flow slowing step 13 or flow hindering stair 13 with a gradually increasing outer circumference from top to bottom. In the example, in order to ensure the effect of uniform condensation, a cylindrical condensation rod is designed, and at the same time, it facilitates the condensed water, when aggregating to a certain volume, smoothly sliding down. When the condensed water slides down, the condensed water on the condensation rod 1 is suddenly reduced. To ensure that a certain amount of atomizing medium (i.e., water) is attached to the condensation rod 1, in the example, the flow hindering stair 13 with a gradually increasing outer circumference is designed to keep water on the flow hindering stair 13 at all times for discharge atomization, and to ensure the material safety and service life of the condensation rod 1. The condensing surface 11 of the condensation rod may have multiple flow hindering stairs 13 as shown in FIG. 3.

In the example, the atomizing electrode includes an emitter and a counter pole, the emitter is the condensation rod, the counter pole is disposed adjacent to the condensation rod, and the high voltage power supply is applied or connected between the condensation rod and the counter pole. Using the condensation rod as one of the atomizing electrodes is helpful to control an atomizing gap and atomizing effect.

Figure 4:
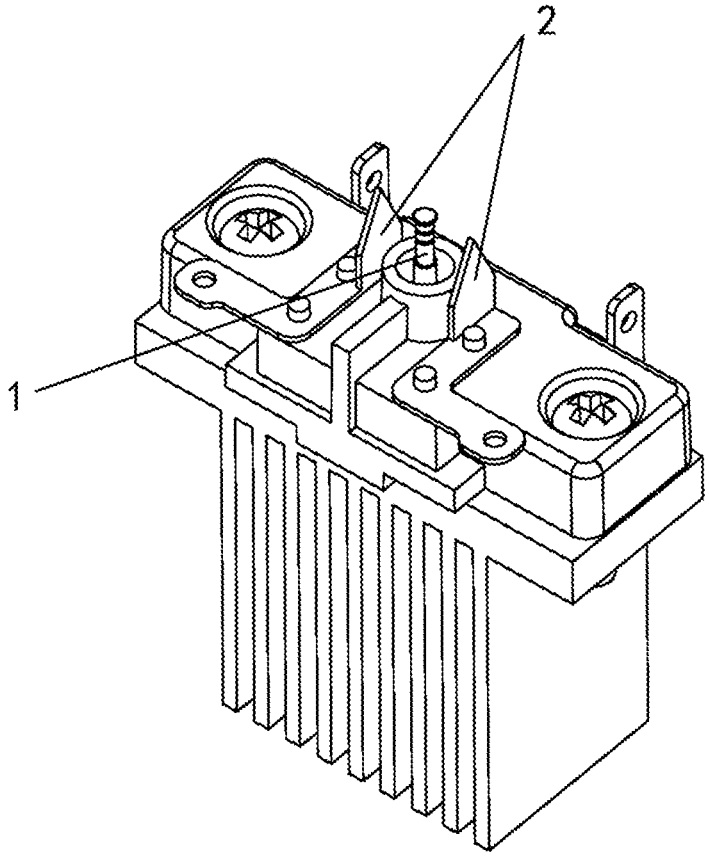
FIG. 4 is a block diagram illustrating an apparatus for generating water droplets according to an example.
Figure 5:
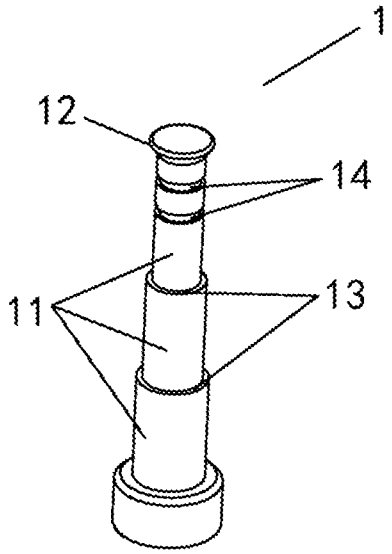
FIG. 5 is a block diagram illustrating a condensation rod according to an example.

The difference between this example and the first example is that, as shown in FIG. 4 and FIG. 5, the atomizing electrode 2 includes an emitter and a counter pole, the emitter and the counter pole are respectively disposed on two sides of the condensation rod 1, and a high voltage power supply is applied or connected between the emitter and the counter pole. The emitter and the counter pole on both sides of the condensation rod 1 are provided, so that the function of the condensation rod 1 is more specialized, and not undertaking the discharge function can simplify processing technology of the condensation rod and achieve optimal condensation effect.

In the example, the condensing surface 11 is provided with a water collecting groove 14, and the water collecting groove is an annular water collecting groove that is recessed around the condensing surface. To ensure attachment of the atomizing medium on the condensation rod, the water collecting groove 14 is provided, and the annular water collecting groove which is recessed around the condensing surface can ensure uniform condensed water volume in the water collecting groove 14 and good discharge atomization effect.

Figure 6:
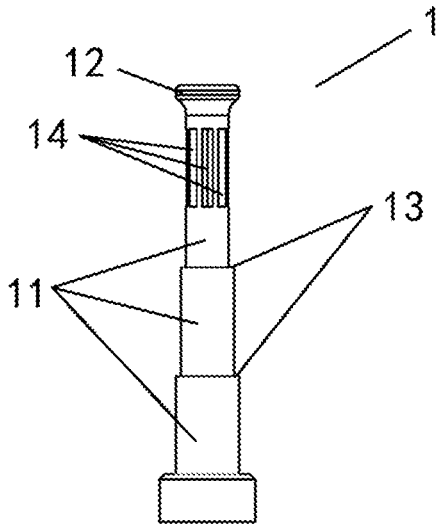
FIG. 6 is a block diagram illustrating a condensation rod according to an example.

The difference between this example and the first example is that, as shown in FIG. 6, the water collecting end is transitionally connected to the condensing surface via a concave arc. When the apparatus is in airflow, the condensed water may move from the condensing surface 11 to the water collecting end 12. To prevent the condensed water from flowing to the top of the water collecting end 12, the water collecting end 12 and the condensing surface 11 are designed to have a concave arc transition. The concave arc transition makes the movement direction of condensed water change from the longitudinal diversion to the transverse direction, so that the condensed water is discharged around the water collecting end 12.

In the example, the condensing surface 11 is provided with a water collecting groove 14, and the water collecting groove 14 is a longitudinal water collecting groove disposed along an axial direction of the condensation rod 1, and the longitudinal water collecting groove is arranged along a circumference of the condensing surface. As shown in FIG. 6, multiple longitudinal water collecting grooves are provided in parallel on the condensing surface. The longitudinal water collecting grooves 14 circumferentially arranged are suitable for more environments, and the water collecting grooves are not interfered with each other, ensuring a minimum amount of condensation.

The examples of the present disclosure provide an apparatus for generating water droplets which improves yield of product forming, reduces processing costs, simplifies processing technology, and improves gathering effect of condensed water.

The condensation rod in the examples of the present disclosure is a cylinder that is rotationally symmetric about a central axis, and the circumferential surface of the cylinder is a condensing surface for aggregating condensed water, allowing the condensed water to be condensed to the condensing surface of the cylinder of the condensation rod, so that the condensed area available for the condensed water is relatively large. Since the condensation rod is in the shape of the cylinder, and there is no inclined tapered slope on the circumferential surface of the condensation rod, the water in the air may be uniformly condensed on the condensing surface of the cylinder. When the condensed water aggregates to a certain volume, it may slide down smoothly to avoid excessive amount of water wrapped around the condensation rod and weakening atomization effect.

A top of the condensation rod has a water collecting end that expands outward from the condensing surface, and a diameter of an outer edge of the water collecting end is larger than a circumferential diameter of the condensing surface. In the examples of the present disclosure, the top of the condensation rod is provided with the water collecting end, and its diameter of the outer edge is larger than the circumferential diameter of the condensing surface. When condensed water is generated on the condensing surface, due to occlusion of the water collecting end, the condensed water may be effectively prevented from coming off the condensing surface driven by air flow.

A top surface of the water collecting end is flat. To avoid discharge of the condensation rod on its top, a flat water collecting end is provided to avoid movement of charged ions attached to the condensation rod towards the top of the condensation rod.

The water collecting end is smoothly and transitionally connected to the condensing surface. In order to prevent the charged ions attached to the condensation rod from moving toward a sharp angle joint to cause a discharge phenomenon, the water collecting end and the condensing surface adopt a smooth transition to avoid a connection sharp angle.

The water collecting end is transitionally connected to the condensing surface via a concave arc. When the apparatus is in the airflow, the condensed water may move from the condensing surface to the water collecting end. To prevent the condensed water from flowing to the top of the water collecting end, the water collecting end and the condensing surface are designed to have a concave arc transition. The concave arc transition makes the movement direction of the condensed water change from the longitudinal diversion to the transverse direction, so that the condensed water is discharged around the water collecting end.

The condensing surface of the condensation rod has a flow hindering stair with a gradually increasing outer circumference from top to bottom. In the examples of the present disclosure, in order to ensure the effect of uniform condensation, a cylindrical condensation rod is designed, and at the same time, it facilitates the condensed water, when aggregating to a certain volume, smoothly sliding down. When the condensed water slides down, the condensed water on the condensation rod is suddenly reduced. To ensure that a certain amount of atomizing medium is attached to the condensation rod, the flow hindering stair with a gradually increasing outer circumference is designed to keep water on the flow hindering stair at all times for discharge atomization, and to ensure the material safety and service life of the condensation rod.

The atomizing electrode includes an emitter and a counter pole, and the emitter is the condensation rod, the counter pole is disposed adjacent to the condensation rod, and the high voltage power supply is connected between the condensation rod and the counter pole. Using the condensation rod as one of the atomizing electrodes is helpful to control an atomizing gap and atomizing effect.

Alternatively, the atomizing electrode includes an emitter and a counter pole, and the emitter and the counter pole are disposed on two sides of the condensation rod, respectively, and a high voltage power supply is connected between the emitter and the counter pole. The emitter and the counter pole on both sides of the condensation rod are provided, so that the function of the condensation rod is more specialized, and not undertaking the discharge function can simplify processing technology of the condensation rod and achieve optimal condensation effect.

The condensing surface is provided with a water collecting groove, and the water collecting groove is an annular water collecting groove that is recessed around the condensing surface. To ensure attachment of the atomizing medium on the condensation rod, the water collecting groove is provided, and the annular water collecting groove which is recessed around the condensing surface can ensure uniform condensed water volume in the water collecting groove and good discharge atomization effect.

Alternatively, the condensing surface is provided with a water collecting groove, the water collecting groove is a longitudinal water collecting groove disposed along an axial direction of the condensation rod, and the longitudinal water collecting groove is arranged along a circumference of the condensing surface. The longitudinal water collecting grooves circumferentially arranged are suitable for more environments, the water collecting grooves are not interfered with each other, and a minimum amount of condensation is ensured.

The apparatus for generating water droplets according to the examples of the present disclosure has a uniform condensing surface for condensed water to achieve excellent gathering effect of the condensed water, and quantity of the condensed water is balanced and the condensed water is not easy to be escaped. The condensation rod has a high yield and a long service life. The condensation rod may be used exclusively for condensation or may also perform the discharge function. The shape of the condensation rod is suitable for various application environments.

The above implementation manners are only examples of the present disclosure, rather than all examples of the present disclosure. According to the principles of the present disclosure, the person skilled in the art could make various modifications. Such modifications without departing from the spirit of the present disclosure should belong to the scope of the present disclosure.

What is claimed is:

1. An apparatus for generating water droplets, comprising:

a condensation rod for condensing water vapor in air around the condensation rod on the condensation rod, the condensation rod being a cylinders having respective stairs and being rotationally symmetric about a central axis, and a circumferential surface of a cylinder being a condensing surface for aggregating condensed water;

a cooling device being in contact with the condensation rod for cooling the condensation rod;

an atomizing electrode; and a voltage power supply for applying a voltage to the atomizing electrode, and causing the condensed water on the condensation rod to be excited by a pressure corona to form atomized water droplets, wherein the condensing surface is provided with a water collecting groove, and the water collecting groove is an annular water collecting groove that is recessed around the condensing surface to ensure uniform condensed water volume in the water collecting groove, wherein the atomizing electrode comprises an emitter and a counter pole, the emitter and the counter pole are respectively disposed on two sides of the condensation rod, the emitter and the counter pole are set parallel to each other and respectively parallel with the condensation rod, and the voltage power supply is connected between the emitter and the counter pole.

2. The apparatus according to claim 1, wherein a top of the condensation rod has a water collecting end that expands outward from the condensing surface, and a diameter of an outer edge of the water collecting end is larger than a circumferential diameter of the condensing surface.

3. The apparatus according to claim 2, wherein a top surface of the water collecting end is flat.

4. The apparatus according to claim 1, wherein the water collecting end is transitionally connected to the condensing surface via a concave arc.

5. The apparatus according to claim 1, wherein the condensing surface of the condensation rod has a flow hindering stair with a gradually increasing outer circumference from top to bottom.

6. An apparatus for generating water droplets, comprising:

a condensation rod for condensing water vapor in air around the condensation rod on the condensation rod, the condensation rod being a cylinders having respective stairs and being rotationally symmetric about a central axis, and a circumferential surface of a cylinder being a condensing surface for aggregating condensed water;

a cooling device being in contact with the condensation rod for cooling the condensation rod;

an atomizing electrode; and a voltage power supply for applying a voltage to the atomizing electrode, and causing the condensed water on the condensation rod to be excited by a pressure corona to form atomized water droplets, wherein the condensing surface is provided with a water collecting groove, the water collecting groove is a longitudinal water collecting groove disposed along an axial direction of the condensation rod, and the longitudinal water collecting groove is arranged along a circumference of the condensing surface, wherein the atomizing electrode comprises an emitter and a counter pole, the emitter and the counter pole are respectively disposed on two sides of the condensation rod, the emitter and the counter pole are set parallel to each other and respectively parallel with the condensation rod, and the voltage power supply is connected between the emitter and the counter pole.

7. The apparatus according to claim 6, wherein a top of the condensation rod has a water collecting end that expands outward from the condensing surface, and a diameter of an outer edge of the water collecting end is larger than a circumferential diameter of the condensing surface.

8. The apparatus according to claim 7, wherein a top surface of the water collecting end is flat.

9. The apparatus according to claim 6, wherein the water collecting end is transitionally connected to the condensing surface via a concave arc.

10. The apparatus according to claim 6, wherein the condensing surface of the condensation rod has a flow hindering stair with a gradually increasing outer circumference from top to bottom.

* * * * *